US007089914B2

(12) United States Patent
Joos et al.

(10) Patent No.: US 7,089,914 B2
(45) Date of Patent: Aug. 15, 2006

(54) METHOD, COMPUTER PROGRAM AND CONTROL AND/OR REGULATION DEVICE FOR OPERATING AN INTERNAL COMBUSTION ENGINE, AND CORRESPONDING INTERNAL COMBUSTION ENGINE

(75) Inventors: Klaus Joos, Walheim (DE); Jens Wolber, Gerlingen (DE); Thomas Frenz, Noerdlingen (DE); Markus Amler, Leonberg-Gebersheim (DE); Hansjoerg Bochum, Novi, MI (US)

(73) Assignee: Robert Bosch GmbH, Stuttgart (DE)

( * ) Notice: Subject to any disclaimer, the term of this patent is extended or adjusted under 35 U.S.C. 154(b) by 579 days.

(21) Appl. No.: 10/203,554

(22) PCT Filed: Dec. 6, 2001

(86) PCT No.: PCT/DE01/04604

§ 371 (c)(1),
(2), (4) Date: Nov. 20, 2002

(87) PCT Pub. No.: WO02/48532

PCT Pub. Date: Jun. 20, 2002

(65) Prior Publication Data

US 2003/0145830 A1 Aug. 7, 2003

(30) Foreign Application Priority Data

Dec. 12, 2000 (DE) ..... 100 61 856

(51) Int. Cl.
*F02M 37/04* (2006.01)

(52) U.S. Cl. ..... 123/456; 123/179.17

(58) Field of Classification Search ..... 123/456, 123/446, 447, 514, 179.17, 506
See application file for complete search history.

(56) References Cited

U.S. PATENT DOCUMENTS

| | | | | |
|---|---|---|---|---|
| 5,394,844 | A * | 3/1995 | Akimoto | 123/179.17 |
| 5,598,817 | A * | 2/1997 | Igarashi et al. | 123/179.17 |
| 5,839,420 | A * | 11/1998 | Thomas | 123/478 |
| 5,878,718 | A * | 3/1999 | Rembold et al. | 123/456 |
| 5,918,578 | A * | 7/1999 | Oda | 123/456 |
| 6,021,763 | A * | 2/2000 | Yoshihara et al. | 123/516 |
| 6,024,064 | A * | 2/2000 | Kato et al. | 123/179.17 |

FOREIGN PATENT DOCUMENTS

| | | |
|---|---|---|
| DE | 195 39 885 A | 11/1996 |
| EP | 0 237 754 A | 9/1987 |

OTHER PUBLICATIONS

Patent Abstracts of Japan, vol. 1998, No. 1, Jan. 30, 1998; with JP 09 250426 A (Toyota Motor Corp.); Sep. 22, 1997; Zusammenfassung.
Patent Abstracts of Japan, vol. 1997, No. 07, Jul. 31, 1997; with JP 09 088763 A (Fuji Heavy Ind. Ltd.); Mar. 31, 1997; Zusammenfassung.
Patent Abstracts of Japan, vol. 1997, No. 10, Oct. 31, 1997; with JP 09 166061 A (Mitsubishi Motors Corp.): Jun. 24, 1997; Zusammenfassung.

* cited by examiner

*Primary Examiner*—C. S. Miller
(74) *Attorney, Agent, or Firm*—Ronald E. Greigg

(57) ABSTRACT

A method for operating an internal combustion engine, in particular of a motor vehicle including at least one fuel pump delivers the fuel from a fuel tank into a fuel line. The pressure of the fuel, at least in a region of the fuel line, is increased as a function of an operating state. In order to assure a reliable starting of the engine, the pressure of the fuel, at least In the above-mentioned region of the fuel line is at least intermittently increased when the engine is not running.

15 Claims, 3 Drawing Sheets

METHOD, COMPUTER PROGRAM AND CONTROL AND/OR REGULATION DEVICE FOR OPERATING AN INTERNAL COMBUSTION ENGINE, AND CORRESPONDING INTERNAL COMBUSTION ENGINE

CROSS-REFERENCE TO RELATED APPLICATIONS

This application is a 35 U.S.C. 371 application of PCT/DE 01/04604, filed on Dec. 6, 2001.

FIELD OF INVENTION

The invention relates to a method for operating an internal combustion engine, in particular of a motor vehicle, in which at least one fuel pump delivers the fuel from a fuel tank into a fuel line and in which the pressure of the fuel, at least in a region of the fuel line, is increased as a function of an operating state.

DESCRIPTION OF PRIOR ART

A method of the type with which the invention is concerned is known from DE 195 39 885 A1. This reference relates to a fuel supply system of an internal combustion engine. The fuel supply system includes two series connected fuel pumps as well as a number of fuel valves that each inject directly into a combustion chamber. In the known method, a valve device assures that during the starting process of the engine, one of the two fuel pumps delivers the fuel to the fuel valves at an increased pressure. This rinses vapor bubbles out of the fuel line or compresses them in the fuel line, thus permitting the engine to be started in a sufficiently short time.

The method proposed in DE 195 39 885 does in fact improve the starting behavior of the engine considerably. However it has turned out that an even greater improvement of the starting behavior and in particular a reduction in the starting time of the engine is sought. The object of the current invention, therefore, is to modify a method of the type mentioned above so that the starting behavior of the engine is improved further.

This object is attained with a method of the type mentioned above by virtue of the fact that the pressure of the fuel is at least intermittently increased in the above-mentioned region of the fuel line when the engine is not runninq.

BACKGROUND OF THE INVENTION

The method according to the invention has the advantage that even when the engine is at rest, i.e. when it is not running, the pressure of the fuel is increased in relation to the normal pressure, which prevents the formation of vapor bubbles from the start. In contrast to the prior art, therefore, the method according to the invention does not rinse already existing gas bubbles out of the fuel lines, but rather prevents them from forming in the first place. This makes it possible to supply fuel to the combustion chambers of the engine even faster during the starting process, which accelerates the starting process itself and improves the starting behavior of the engine.

Increasing the fuel pressure in the fuel line only when the engine is not operating also has the advantage over a continuously elevated fuel pressure that the components of the engine are under less stress during normal operation.

This applies in particular to the fuel pump, whose service life is extended by the lower normal pressure and also applies to the fuel lines, which are less susceptible to permeation at the lower normal pressure.

Advantageous modifications of the invention are disclosed in the dependent claims.

A first modification provides that the pressure of the fuel, at least in the above-mentioned region of the fuel line, is increased when the engine is not running if the temperature of the engine is above a limit value. The formation of vapor bubbles is particularly likely when the fuel in the fuel lines is warm. Such a heating of the fuel is in turn to be expected when the engine is switched off after a long period of operation and due to heat dissipation, the hot engine heats the fuel line, the fuel pump, and/or other elements of the fuel system.

The modification of the method according to the invention, takes into account this heating of the fuel. On the other hand, the increase of the fuel pressure in the fuel line is also eliminated when the engine is not running if, for example, the engine is started for only a short time, i.e. it has not reached a high operating temperature and therefore no vapor bubble-inducing heating of the fuel in the fuel line is to be expected.

The invention also proposes that the pressure of the fuel in the above-mentioned region of the fuel line remain elevated at least during the starting of the engine and preferably during a time interval after the starting of the engine. This accelerates a reliable starting of the engine even more and, with a high degree of reliability, assures a smooth and safe operation of the engine after the starting procedure.

It is particularly preferable if the period of time during which the pressure of the fuel remains elevated after the starting of the engine, at least in the above-mentioned region of the fuel line, depends on the temperature of the engine. As explained above, the probability of the formation of vapor bubbles depends on the temperature of the fuel, which in turn depends on the temperature of the engine. During operation of a very hot engine, for example an engine that is started again after a long period of operation followed by a short intermediary stop, the danger of vapor bubbles being produced is particularly pronounced. In this instance, the pressure of the fuel should remain elevated for a particular time interval, which depends on the temperature of the engine. If need be, the pressure can be reduced again when the temperature of the engine has fallen below a limit value.

In a particularly preferred modification of the method according to the invention, a high-pressure region and a low-pressure region of the fuel line are connected to each other during the phase with the increased pressure of the fuel, at least in a region of the fuel line, particularly when the engine is not running. Such a fuel line with a high-pressure region and a low-pressure region is used, for example, in internal combustion engines with gasoline direct injection.

In a fuel system of this kind, the fuel is first delivered by an electric fuel pump into the low-pressure region of the fuel line and is supplied to a high-pressure pump directly driven by the engine. This high-pressure pump delivers the fuel at very high pressure (up to 120 bar) into a fuel accumulation line, which is also referred to as a "rail". From this rail, the fuel is supplied directly to the injection valves, which inject the fuel directly into the combustion chambers of the engine.

Normally when the engine is not running, the high-pressure region and the low-pressure region of the fuel line are separated from each other. The high-pressure components of a high-pressure region, e.g. the high-pressure pump, the high-pressure injection valves, a quantity control valve, and a pressure control valve, are sometimes subjected to the high pressure in the high-pressure region for a very long period of time. If the high-pressure region is connected to the low-pressure region during the phase with the increased pressure of the fuel, this automatically results in a reduction of the pressure in the high-pressure region to a common pressure value, which is, however, higher than the usual pressure value in the low-pressure region of the fuel line, thus preventing vapor bubbles.

The components in the high-pressure region of the fuel line are consequently no longer subjected to the particularly high pressure so that the sealing demands on these components are reduced. This reduces the production costs for the corresponding components and possibly also increases the service life of these components.

One possibility for increasing the pressure of the fuel in the above-mentioned region in the above-mentioned manner is comprised in that a device, which sets the pressure of the fuel to a normal level, at least in the above-mentioned region of the fuel line, is switched off during the phase with increased fuel pressure. This variant of the method according to the invention is particularly easy to achieve.

It is also possible for the increase of the pressure of the fuel, at least in the above-mentioned region of the fuel line when the engine is not running, to include the activation of at least one fuel pump after the engine is switched off. Such an activation of the fuel pump is very easy to achieve and contributes to the desired result.

It is also possible for the increase of the pressure of the fuel, at least in the above-mentioned region of the fuel line when the engine is not running, to take place at least by means of a temperature increase of the fuel in the above-mentioned region of the fuel line. This variant of the method according to the invention takes advantage of the increase in the temperature of the fuel that is expected anyway: heat dissipation from the hot engine can cause such a temperature increase, which due to the closed volume of the fuel in the fuel line, causes the desired pressure increase. In this modification of the method according to the invention, therefore, the pressure increase is produced in a particularly simple manner.

The invention also relates to a computer program, which is suitable for executing the above-mentioned method when it is run on a computer. It is particularly preferable if the computer program is stored in a memory, in particular a flash memory.

The invention also relates to a control and/or regulating unit for operating an internal combustion engine, in particular of a motor vehicle, in which at least one fuel pump delivers the fuel from a fuel tank into a fuel line and in which the pressure of the fuel, at least in a region of the fuel line, is increased as a function of an operating state. Such a control and/or regulating unit is known from the market. In order to accelerate the starting process of the engine, the invention proposes that the control and/or regulating unit be suitable for controlling and/or regulating the above-mentioned method. It is particularly preferable if the control and/or regulating unit is provided with a computer program of the above-mentioned type.

The invention also relates to an internal combustion engine with at least one fuel pump that delivers fuel into a fuel line and with a device that can increase the pressure of the fuel, at least in a region of the fuel line, as a function of an operating state of the engine. An internal combustion engine of this kind is also known from the market. In order to be able to start this engine better, the invention proposes that it be provided with a control and/or regulating unit of the above-mentioned type.

In the engine according to the invention, in order to be able to produce the simplest possible pressure increase of the fuel pressure in the fuel line that can be achieved with the control and/or regulating unit, the invention proposes that the engine have a first pressure adjusting device, which can adjust a normal pressure of the fuel, at least in a region of the fuel line.

The invention also proposes that the engine have a second pressure adjusting device that can adjust an increased pressure of the fuel, at least in the above-mentioned region of the fuel line; the first and second pressure adjusting device are each connected at least to the above-mentioned region of the fuel line. In addition, the engine should also have a device that can fluidically disconnect the first pressure adjusting device at least from the above-mentioned region of the fuel line when the engine is not running.

The assembly of the above-mentioned components is simplified by virtue of the fact that the pressure adjusting devices and the disconnecting device are integrated into a module.

DESCRIPTION OF DRAWINGS

An exemplary embodiment of the invention will be explained in detail below with reference to the accompanying drawings.

DESCRIPTION OF THE PREFERRED EMBODIMENT

Figure 1:
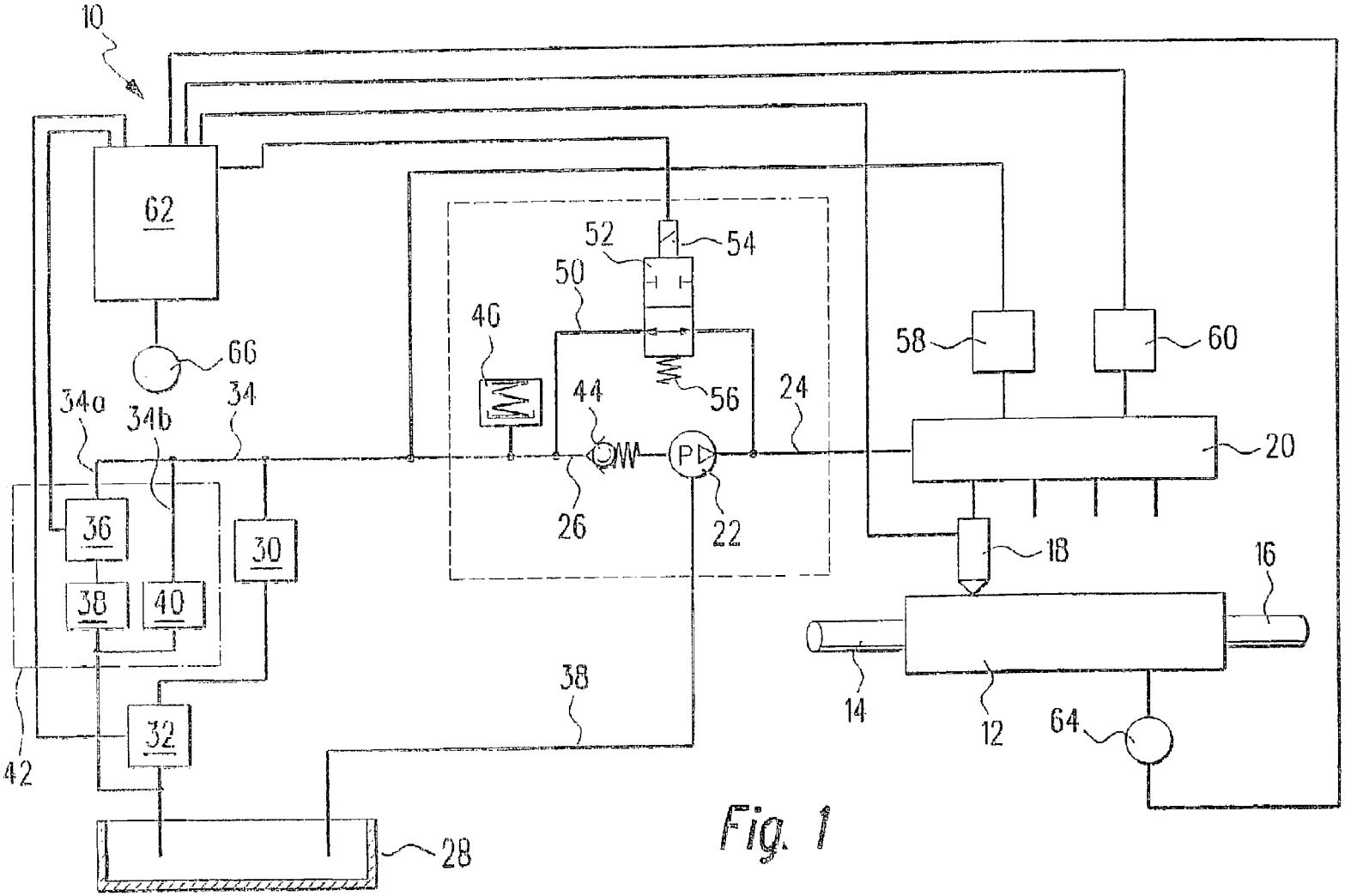
FIG. 1 shows a schematic block circuit diagram of an internal combustion engine.

In FIG. 1, an internal combustion engine is labeled as a whole with the reference numeral 10. It includes a combustion chamber 12, which is supplied with air via an intake tube 14. The exhaust gases are carried away by an exhaust tube 16.

The fuel is supplied to the combustion chamber 12 by means of injection valves 18, only one of which is shown in FIG. 1. The injection valves 18 are connected to a fuel accumulation line 20, which is commonly referred to as a "rail". The fuel is delivered to the fuel accumulation line 20 by means of a high-pressure pump 22 and is placed under pressure. A high-pressure fuel line 24 is provided between the high-pressure pump 22 and the fuel accumulation line 20. The high-pressure pump 22, the high-pressure fuel line 24, and the fuel accumulation line 20 constitute a high-pressure region of the fuel system. A low-pressure fuel line 26 leads from the high-pressure pump 22 to a tank 28. A fuel filter 30 and an electric fuel pump 32 are disposed in the low-pressure fuel line 26. A branch line 34 branches from the low-pressure fuel line 26 between the fuel filter 30 and high-pressure pump 22 and feeds back into the low-pressure fuel line 26 between the electric fuel pump 32 and the tank 28. The branch line 34 in turn branches into two parallel branches 34*a* and 34*b*. The branch 34*a* of the branch line 34 contains a shutoff valve 36 and a first pressure controller 38. The first pressure controller 38 is designed so it opens at a pressure of approximately 4 bar in the branch 34*a* of the branch line 34.

The second branch 34*b* of the branch line 34 contains a second pressure controller 40, which opens at a corresponding pressure of approximately 6 bar. The shutoff valve 36, the first pressure controller 38, and the second pressure controller 40 are integrated into a module 42, which is integrated into the cover of the tank 28 in a manner not shown in detail in FIG. 1. This makes it easier to install the pressure controllers 38 and 40 and the valve 36. A check valve 44, which closes in the direction of the tank 28, and a pressure damper 46 are also provided between the high-pressure pump 22 and the fuel filter 30.

An overflow line 38 leads from the high-pressure pump 22 to the tank 28. Fuel, which overflows from the high-pressure pump 22 due to the high pressure in the fuel accumulation line 20 and the high-pressure fuel line 24, is conveyed back to the tank 38 via this overflow line 38. A return line 50 is connected on the one end to the high-pressure fuel line 24 between the high-pressure pump 22 and the fuel accumulation line 20 and is connected at the other end to the low-pressure fuel line 26 between the pressure damper 46 and the high-pressure pump 22. A quantity control valve 52 is inserted in the return line 50.

This quantity control valve 52 is a 2/2-port directional-control valve, which in its extreme position, completely closes the return line 50 and in the other extreme position, completely opens the return line 50. The quantity control valve 52 is actuated by a magnetic actuator 54. When it is without power, the quantity control valve 52 is pressed into its completely open extreme position by a spring 56.

The fuel accumulation line 20 is connected to a pressure control valve 58, which in turn is fluidically connected to the low-pressure fuel line 26 at a point between the pressure damper 46 and the filter 30. The pressure control valve 58 is a spring-loaded ball valve with an opening pressure of approximately 125 bar.

The pressure in the fuel accumulation line 20 is detected by a pressure sensor 60, which sends corresponding signals to a control and regulating unit 62. This unit also receives signals from a temperature sensor 64 that measures the temperature of the engine 10, e.g. the temperature of cooling water (not shown). On the input side, the control and regulating unit 62 is also connected to a position sensor 66 of an ignition lock (not shown). On the output side, the control and regulating unit 62 is connected to the magnetic actuator 54 of the quantity control valve 52, the injection valves 18, the electric fuel pump 32, and the shutoff valve 36.

During normal operation of the engine 10, the control and regulating unit 62 triggers the shutoff valve 36 so that it is open and the branch 34*a* of the branch line 34 is open. The fuel that the electric fuel pump 32 delivers from the tank 28 into the low-pressure fuel line 26 is therefore set by the pressure controller 38 to a pressure of approximately 4 bar. The pressure controller 40 in the second branch 34*b* of the branch line 34 is not active because it only opens with a pressure of approximately 6 bar in the branch line 34 (naturally, the pressure in the branch line 34 and in the sections 34*a* and 34*b* is equal to the pressure in the region of the low-pressure fuel line 26, which is disposed between the fuel pump 32 and the high-pressure pump 22).

The branch line 34 and the components 36, 38, and 40 contained therein, the low-pressure fuel line 26, and the electric fuel pump 32 thus constitute a low-pressure region of the fuel line. This fuel, which is "precompressed" to 4 bar, is compressed to a pressure of approximately 125 bar by the high-pressure pump 22 and is conveyed into the high-pressure fuel line 24 in the direction of the fuel accumulation line 20. The rate of flow is controlled by the quantity control valve 52.

In order to be able to start the engine 10 as rapidly as possible, when the engine 10 is not running, a process is executed, which will now be explained in detail with reference to FIG. 2. A non-running state is understood to be one in which the engine 10 is switched off, i.e. the crankshaft (not shown) is not rotating and, for example, the ignition is also switched off. The process shown in FIG. 2 is stored in the form of a computer program in the control and regulating unit 62.

After a start block of 68, in block 70, the program checks whether, based on the position of the position sensor 66 of the ignition lock or based on a movement of this position sensor 66, a shutdown sequence of the engine 10 has been initiated. If so, in block 72, the program checks whether the temperature T of the engine 10 detected by the temperature sensor 64 (for example the temperature of the cooling water of the engine 10) is greater than a limit value TG. If this is also true, then in block 74, the control and regulating unit 62 triggers the shutoff valve 36 so that it closes. In block 75, the electric fuel pump 32 is switched on and after a certain time interval has elapsed (block 76), the electric fuel pump 32 is switched back off in block 78. In block 80, a flag is set. The program ends in the end block 82. The process also leaps to block 82 if the answers to the queries in blocks 70 or 72 are negative.

Figure 2:
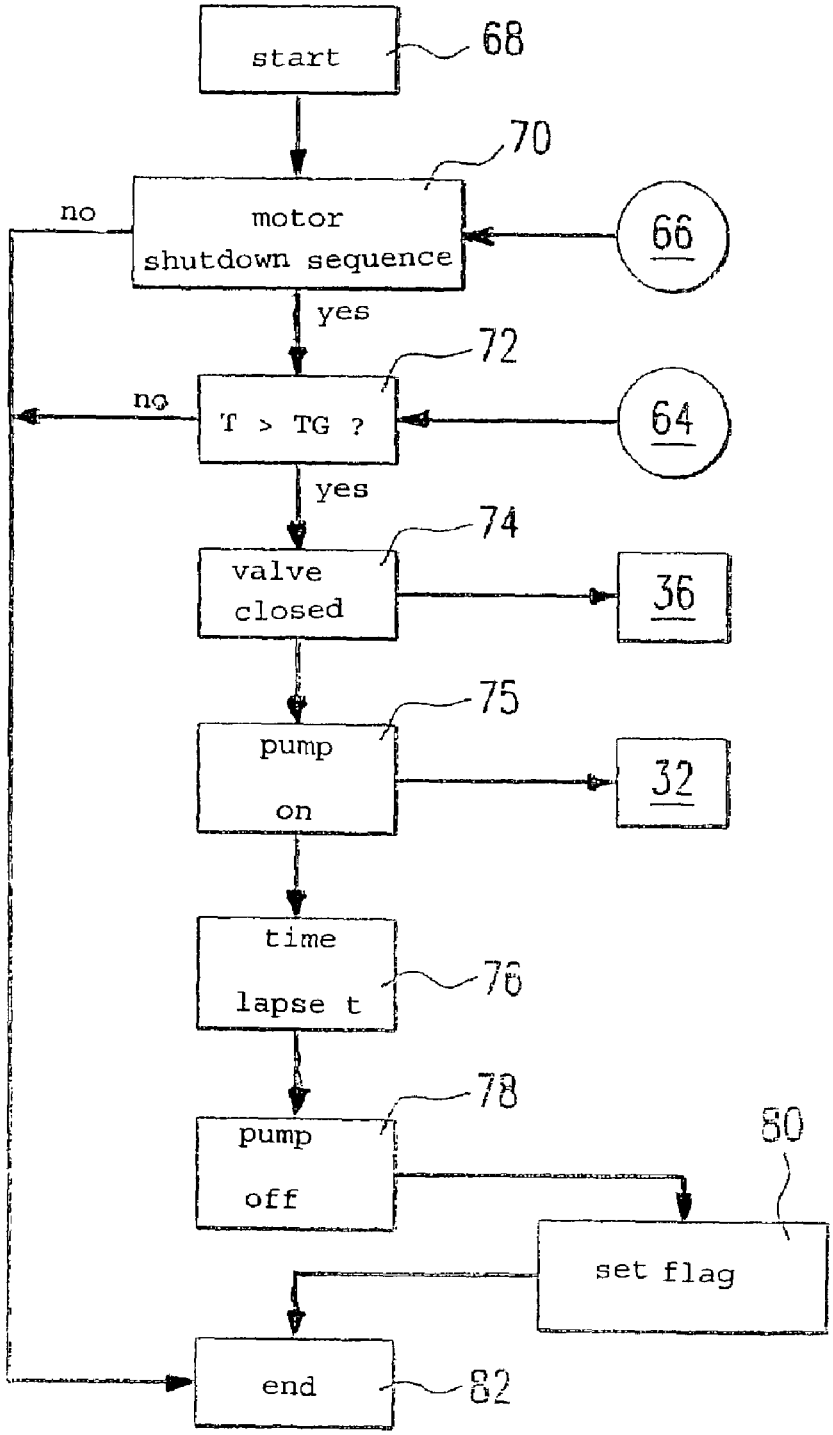
FIG. 2 shows a flowchart of a first method for operating the internal combustion engine from FIG. 1.

When the engine 10 is switched off by turning the ignition key in the ignition lock, and when the determination is made that the temperature T of the engine is higher than a limit value TG, the method shown in FIG. 2 causes the pressure controller 38 to be deactivated by the closed shutoff valve 36. If the fuel pump 32 is then switched on in block 75, the pressure control in the low-pressure fuel line 26 is set by the second pressure controller 40 in branch 34*b* of the branch line 34, i.e. the pressure is set to a higher pressure, namely 6 bar in this instance. This increased pressure in the low-pressure fuel line 26 causes already existing vapor bubbles to be compressed and reliably prevents new vapor bubbles from being produced. In an exemplary embodiment that is not shown, the pressure increase is produced additionally or exclusively by means of the heating of the fuel due to the heat dissipation from the hot engine.

Since the 2/2-port quantity control valve 52, when it is without current when the engine 20 is not running, is pressed into its completely open position by the spring 56, the low-pressure fuel line 26 is fluidically connected to the high-pressure fuel line 24. Therefore, the same pressure prevails in both of the fuel lines 24 and 26 and in the fuel accumulation line 20, namely the pressure of 6 bar that is mentioned above. This pressure is considerably lower than the pressure otherwise present in the high-pressure region of the fuel system. This reduced pressure in the high-pressure region of the fuel system when the engine is not running considerably reduces the sealing demands on the components in the high-pressure region, for example the injection valves 18, so that they can be more simply and inexpensively designed.

Figure 3:
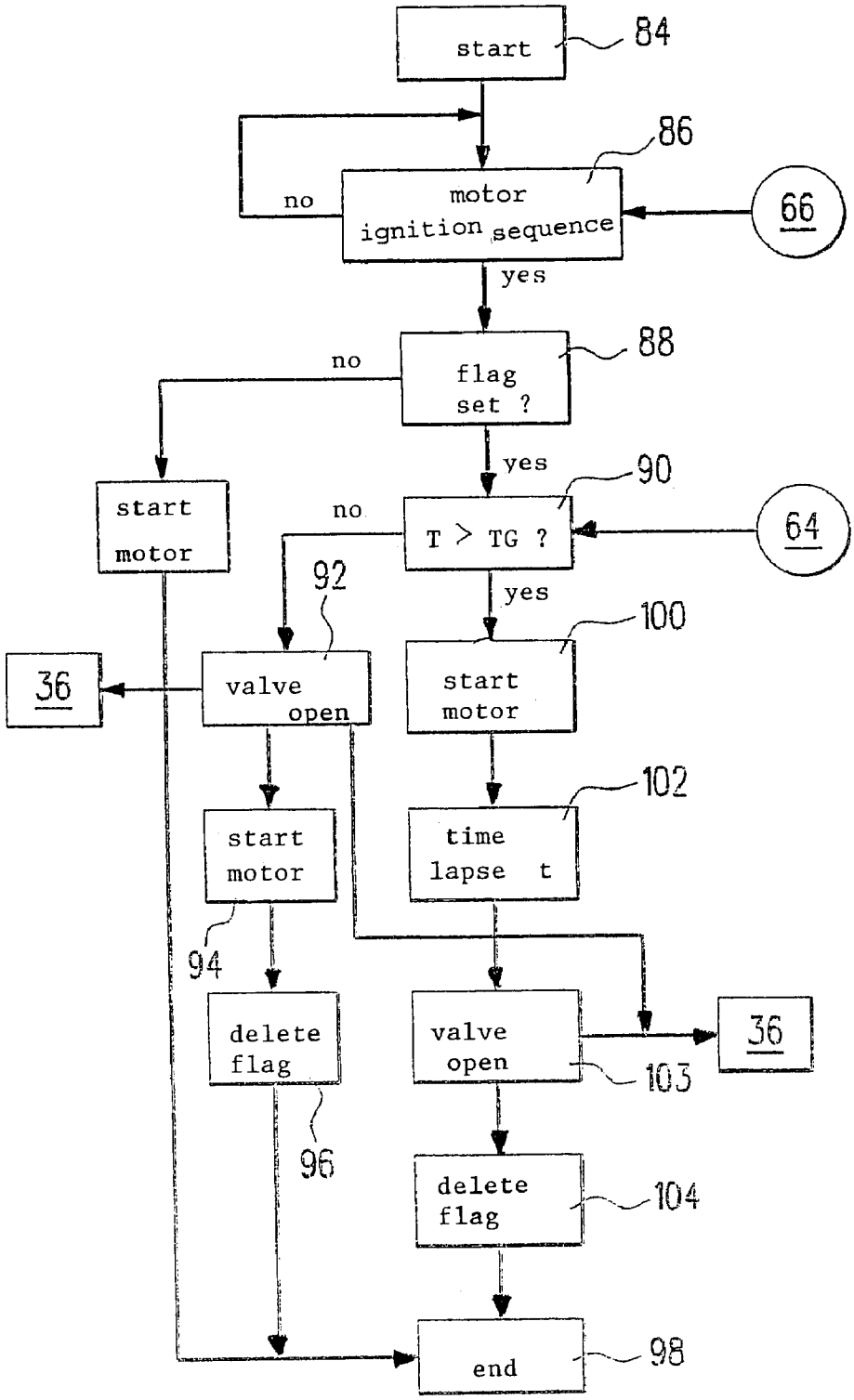
FIG. 3 shows a flowchart of a second method for operating the internal combustion engine from FIG. 1.

When the engine 10 is started, the following procedures are executed (the corresponding method shown in FIG. 3 is likewise stored in the form of a computer program in the control and regulating unit 62):

After a start block 84, in block 86, the program executes a query as to whether—for example due to a corresponding movement of the key in the ignition lock, which is detected by the position sensor 66—an ignition sequence of the engine 10 is in progress. If so, then in block 88, the program executes a query as to whether the flag has been set. If this is also the case, which indicates that during the preceding non-operation of the engine 10, an increased fuel pressure was set in the low-pressure fuel line 26, then in block 90, the program queries the temperature T of the engine 10 detected by the temperature sensor 64 and compares it to a limit value TG.

If the actual temperature T of the engine 10 is lower than the limit value TG, then in block 92, the shutoff valve 36 is opened, which reactivates the pressure controller 38 and sets the pressure in the low-pressure fuel line 26 to a lower pressure, 4 bar in this instance, (the quantity control valve 52 was previously closed so that the low-pressure fuel line 26 and the high-pressure fuel line 24 are fluidically decoupled from each other). Then in block 94, the engine 10 is started and in block 96, the flag is deleted. The method finally ends in block 98. This takes into account the fact that if the temperature of the engine is so low that the formation of vapor bubbles in the low-pressure fuel line 26 is not to be expected, then it is not necessary to start the engine 10 with increased pressure of the fuel in the low-pressure fuel line 26.

However, if the actual temperature T of the engine is greater than the limit value TG, i.e. if a so-called "hot start" is being executed, then in block 100, the engine 10 is started. The starting of the engine 10 in this case therefore takes place with the increased pressure of the fuel in the low-pressure fuel line 26 set by the pressure controller 40. After a time interval t, which is determined in block 102, the control and regulating unit 62 triggers the shutoff valve 36 so that it opens (block 103). This reactivates the first pressure controller 38 in the branch line 34*a*, as a result of which the fuel in the low-pressure fuel line 26 is set to a normal pressure of approximately 4 bar.

Since the pressure in the low-pressure fuel line 26 is only reduced after the passage of a particular time interval after the starting of the engine 10, this assures that an elevated fuel pressure prevails during the entire starting process of the engine 10 and even during a period of time that is long enough for the engine 10 to cool down, and this prevents vapor bubbles from being produced in the low-pressure fuel line 26. In block 104, the flag is deleted.

In an exemplary embodiment that is not shown, the time interval t in block 102 can depend on the temperature T of the engine 10. This assures that the pressure in the low-pressure fuel line 26 is only reduced to a normal level if the temperature of the engine 10 has fallen to a point that a formation of vapor bubbles in the low-pressure fuel line 26 is no longer to be expected.

The foregoing relates to preferred exemplary embodiments of the invention, it being understood that other variants and embodiments thereof are possible within the spirit and scope of the invention, the latter being defined by the appended claims.

The invention claimed is:

1. In a method for operating an internal combustion engine (10), in which at least one fuel pump (22, 32) delivers the fuel from a fuel tank (28) into a fuel line (20, 24, 26, 34) and in which the pressure of the fuel, at least in a region (26) of the fuel line (20, 24, 26, 34), is at least intermittently increased when the engine (10) is not running compared to its pressure during normal operation, further comprising the step of connecting a high-pressure region (20, 24) and a low-pressure region (26, 34) of the fuel line (20, 24, 26, 34) to each other during the phase of increased pressure of the fuel, at least in the region (26) of the fuel line (20, 24, 26, 34).

2. The method according to claim 1 wherein the pressure of the fuel, at least in the above-mentioned region (26) of the fuel line (20, 24, 26, 34), is increased when the engine is not running if the temperature (T) of the engine (10) is above a limit value (TG).

3. The method according to claim 1 wherein the pressure of the fuel in the above-mentioned region (26) of the fuel line (20, 24, 26, 34) remains elevated at least during the starting (100) of the engine (10) and preferably during a period of time (102) after the starting (100) of the engine (10).

4. The method according to claim 2 wherein the pressure of the fuel in the above-mentioned region (26) of the fuel line (20, 24, 26, 34) remains elevated at least during the starting (100) of the engine (10) and preferably during a period of time (102) after the starting (100) of the engine (10).

5. The method according to claim 3 wherein after the starting of the engine, the time interval during which the pressure of the fuel remains elevated, at least in the above-mentioned region of the fuel line, depends on the temperature of the engine.

6. The method according to claim 1 comprising providing a device (38), which sets the pressure of the fuel to a normal level, at least in the above-mentioned region (26) of the fuel line (20, 24, 26, 34), and switching off the device (38) during the phase with increased fuel pressure.

7. The method according to claim 1 wherein the increase of the pressure of the fuel, at least in the above-mentioned region (26) of the fuel line (20, 24, 26, 34) when the engine (10) is not running, includes the activation of at least one fuel pump (32) after the engine (10) is switched off (70).

8. The method according to claim 1 wherein the increase of the pressure of the fuel, at least in the above-mentioned region (26) of the fuel line (20, 24, 26, 34) when the engine (10) is not running, also takes place at least by means of a temperature increase of the fuel in the above-mentioned region (26) of the fuel line (20, 24, 26, 34).

9. A computer program, for executing the method according to claim 1, the computer program stored on a computer readable medium.

10. The computer program according to claim 9 characterized in that the program is stored in a flash memory.

11. A control and/or regulating unit (62) for operating an internal combustion engine (10), in particular of a motor vehicle, in which at least one fuel pump (22, 32) delivers the fuel from a fuel tank (28) into a fuel line (20, 24, 26, 34) and in which the pressure of the fuel, at least in a region (26) of the fuel line (20, 24, 26, 34) is increased as a function of an operating state, the control and regulating unit being suitable for controlling and/or regulating the method according to claim 1.

12. The control and/or regulating unit (62) according to claim 11 wherein the control device (62) comprises a computer program stored in a flash memory.

13. An internal combustion engine (10) with at least one fuel pump (22, 32) that delivers fuel into a fuel line (20, 24, 26, 34) and with a device (32, 36, 38), which can increase the pressure of the fuel, at least in a region (26) of the fuel line (20, 24, 26, 34), as a function of an operating state of the engine (10), that it is provided with a control and/or regulating unit (62) according to claim 12.

14. The internal combustion engine according to claim 13 further comprising a first pressure adjusting device (38), which can adjust a normal pressure of the fuel, at least in a region (26) of the fuel line (20, 24, 26, 34), and a second pressure adjusting device (40), which can adjust an increased pressure of the fuel, at least in the above-mentioned region (26) of the fuel line (20, 24, 26, 34), wherein the first (38) and second pressure adjusting device (40) are each connected at least to the above-mentioned region (26) of the fuel line (20, 24, 26, 34), and wherein it also has a device (36), which when the engine (10) is not running, can fluidically disconnect the first pressure adjusting device (38) at least from the above-mentioned region (26) of the fuel line (20, 24, 26, 34).

15. The internal combustion engine according to claim 14, characterized in that the pressure adjusting devices (38, 40) and the disconnecting device (36) are integrated into a module.

* * * * *